US010371337B2

(12) United States Patent
Park et al.

(10) Patent No.: US 10,371,337 B2
(45) Date of Patent: Aug. 6, 2019

(54) LIGHT-EMITTING APPARATUS AND LIGHTING APPARATUS FOR VEHICLES INCLUDING THE SAME

(71) Applicant: LG INNOTEK CO., LTD., Seoul (KR)

(72) Inventors: Kang Yeol Park, Seoul (KR); Ki Cheol Kim, Seoul (KR); Chang Gyun Son, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 15/376,892

(22) Filed: Dec. 13, 2016

(65) Prior Publication Data

US 2017/0167685 A1 Jun. 15, 2017

(30) Foreign Application Priority Data

Dec. 15, 2015 (KR) ..... 10-2015-0178798

(51) Int. Cl.

| | |
|---|---|
| ***F21S 41/14*** | (2018.01) |
| ***F21S 41/36*** | (2018.01) |
| ***F21S 41/25*** | (2018.01) |
| ***F21S 41/20*** | (2018.01) |
| ***F21S 41/32*** | (2018.01) |

(Continued)

(52) U.S. Cl.

CPC ..... *F21S 41/36* (2018.01); *F21S 41/14* (2018.01); *F21S 41/16* (2018.01); *F21S 41/20* (2018.01); *F21S 41/25* (2018.01); *F21S 41/32* (2018.01); *F21S 41/663* (2018.01); *F21S 45/47* (2018.01); *F21Y 2115/30* (2016.08)

(58) Field of Classification Search

CPC ..... F21S 41/20; F21S 41/16; F21S 41/663; F21S 41/25; F21S 41/36

See application file for complete search history.

(56) References Cited

U.S. PATENT DOCUMENTS 3,835,342 A * 9/1974 Freeman ..... H01K 1/325 313/114
2007/0183166 A1* 8/2007 Albou ..... F21V 11/16 362/514

(Continued)

FOREIGN PATENT DOCUMENTS

DE 10 2014 202294 8/2015
EP 2 626 244 8/2013

(Continued)

OTHER PUBLICATIONS

European Search Report dated May 22, 2017 issued in Application No. 16200958.3.

*Primary Examiner* — Jong-Suk (James) Lee
*Assistant Examiner* — Christopher E Dunay
(74) *Attorney, Agent, or Firm* — KED & Associates LLP

(57) ABSTRACT

A light-emitting apparatus includes a light source unit for emitting a first excitation light beam, a beam shape conversion unit for reflecting the first excitation light beam and outputting the reflected first excitation light beam as a second excitation light beam, and a driving unit for driving the light source unit, wherein the beam shape conversion unit includes a plurality of reflective surfaces having different reflection patterns, and the reflective surfaces are arranged in a direction that intersects the direction in which the first excitation light beam is incident.

18 Claims, 10 Drawing Sheets

(51) Int. Cl.

| | |
|---|---|
| ***F21S 41/663*** | (2018.01) |
| ***F21S 41/16*** | (2018.01) |
| *F21S 45/47* | (2018.01) |
| *F21Y 115/30* | (2016.01) |

(56) References Cited

U.S. PATENT DOCUMENTS

| | | | | |
|---|---|---|---|---|
| 2012/0106183 | A1 | 5/2012 | Takahashi | |
| 2013/0265561 | A1 | 10/2013 | Takahira et al. | |
| 2014/0112012 | A1* | 4/2014 | Nakazato | B60Q 1/0088 362/510 |
| 2014/0293631 | A1* | 10/2014 | Lee | F21S 48/328 362/509 |
| 2015/0354761 | A1* | 12/2015 | Nagao | F21S 41/16 362/510 |
| 2016/0238216 | A1* | 8/2016 | Oka | F21V 13/12 |
| 2016/0312981 | A1* | 10/2016 | Park | F21V 7/0033 |
| 2016/0341384 | A1* | 11/2016 | Hoshino | F21V 3/04 |
| 2017/0016586 | A1* | 1/2017 | Tsuda | F21S 48/1145 |

FOREIGN PATENT DOCUMENTS

| | | |
|---|---|---|
| WO | WO 2009/131126 | 10/2009 |
| WO | WO 2015/170696 | 11/2015 |

* cited by examiner

LIGHT-EMITTING APPARATUS AND LIGHTING APPARATUS FOR VEHICLES INCLUDING THE SAME

CROSS-REFERENCE TO RELATED APPLICATION(S)

This application claims priority under 35 U.S.C. § 119 to Korean Application No. 10-2015-0178798 filed on Dec. 15, 2015, whose entire disclosure is herein incorporated by reference.

BACKGROUND

1. Field

Embodiments relate to a light-emitting apparatus and a lighting apparatus for vehicles including the same.

2. Background

Light-emitting diodes (LEDs) are a kind of semiconductor device that sends and receives a signal by converting electricity into infrared light or visible light using the characteristics of compound semiconductors or that are used as light sources. Light-emitting diodes and laser diodes do not contain environmentally hazardous substances, such as mercury (Hg), which are used in conventional lighting apparatuses, such as an incandescent lamp or a fluorescent lamp.

Consequently, the light-emitting diodes and the laser diodes are environmentally friendly. In addition, the light-emitting diodes and the laser diodes exhibit long life spans and low power consumption. As a result, the light-emitting diodes or laser diodes have replaced conventional light sources.

FIG. 1 is a view schematically showing a general headlamp for vehicles. A light-emitting apparatus that uses a light-emitting diode or a laser diode as a light source has been increasingly used in various fields, such as a headlight for vehicles and a flashlight. In a headlamp of a lighting apparatus for vehicles including a light-emitting apparatus, a light source and an optical system for a high beam 10 and a light source and an optical system for a low beam 12 are provided separately. In the case in which the light sources and the optical systems are provided separately, the mechanical structure of the lighting apparatus is complicated, the cost of the manufacturing the lighting apparatus is increased, and it is difficult to slim the lighting apparatus.

BRIEF DESCRIPTION OF THE DRAWINGS

The embodiments will be described in detail with reference to the following drawings in which like reference numerals refer to like elements wherein.

DETAILED DESCRIPTION

Figure 1:
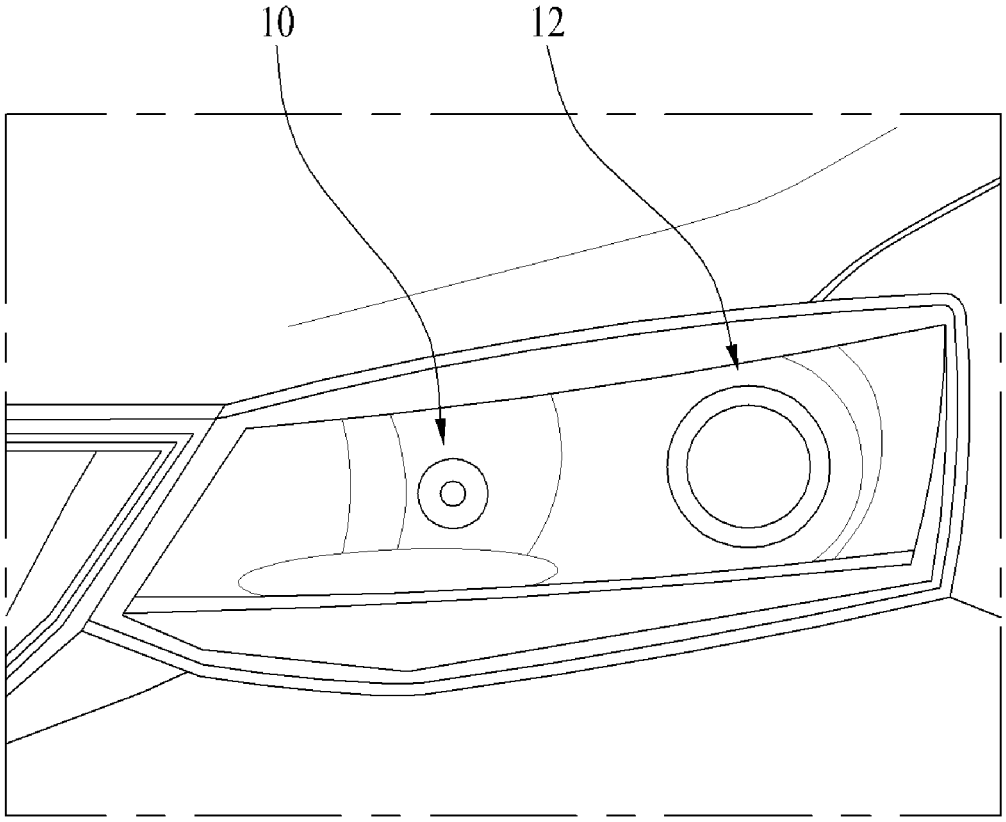
FIG. 1 is a view schematically showing a general headlamp for vehicles.
Figure 2A:
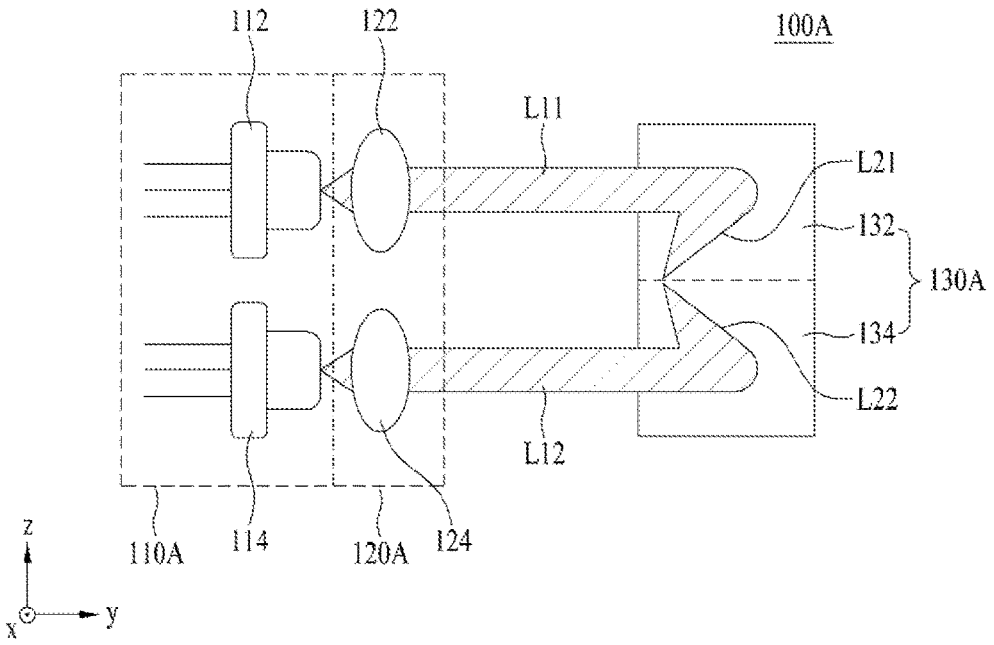
FIGS. 2A and 2B are a plan view and a front view, respectively, showing a light-emitting apparatus according to an embodiment.
Figure 2B:
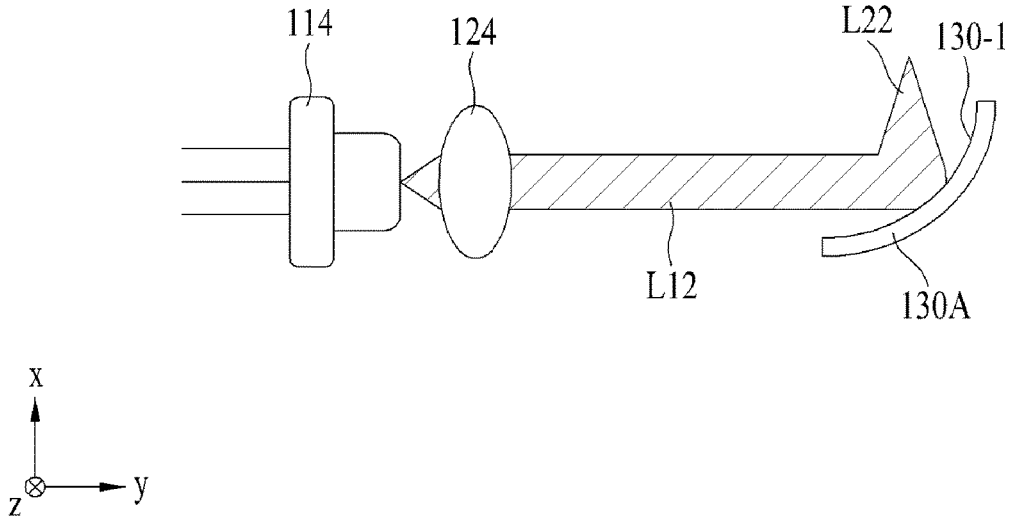

Referring to FIGS. 2A and 2B, the light-emitting apparatus 100A may include a light source unit 110A, a collimating lens unit 120A, and a beam shape conversion unit 130A. The light source unit 110A may emit a plurality of first excitation light beams having linearity. The light source unit 110A may include a plurality of light sources arranged side by side in the direction parallel to the direction in which first excitation light beams are emitted while facing the beam shape conversion unit 130A for emitting the first excitation light beams.

As shown in FIG. 2A, the light source unit 110A may include first and second light sources 112 and 114. However, the disclosure is not limited thereto. In other embodiments, the light source unit 110A may include more than two light sources. The first and second light sources 112 and 114 may be arranged in a direction (e.g. the z-axis direction) that intersects the direction in which the first excitation light beams are emitted (e.g. the y-axis direction).

The first light source 112 may be disposed while facing the beam shape conversion unit 130A to emit a first excitation light beam having linearity (hereinafter, referred to as a "1-1 excitation light beam L11"). The second light source 114 may be disposed while facing the beam shape conversion unit 130A to emit a first excitation light beam having linearity (hereinafter, referred to as a "1-2 excitation light beam L12"). Each of the first and second light sources 112 and 114 may be a light-emitting diode (LED) or a laser diode (LD) for emitting a first excitation light beam. However, the disclosure is not limited thereto.

In the case in which each of the first and second light sources 112 and 114 is realized using a laser diode, it may be possible to achieve higher luminance and efficiency than when using a light-emitting diode. In addition, it may be possible to reduce the size of the light source unit 110A. In the case in which the light-emitting apparatus 100A is used in a lighting apparatus for vehicles, such as a headlamp, each of the first and second light sources 112 and 114 may be realized using a laser diode, rather than a light-emitting diode, in order to emit a sufficient amount of light. However, the disclosure is not limited thereto.

The first excitation light beam emitted from each of the first and second light sources 112 and 114 may have a peak wavelength within a wavelength band of 400 nm to 500 nm. However, the disclosure is not limited thereto.

In addition, each of the first and second light sources 112 and 114 may emit a first excitation light beam having a spectral full width at half maximum (SFWHM) of 10 nm or less. This corresponds to the width of intensity for each wavelength. However, the disclosure is not limited thereto. The spectral full width at half maximum (SFWHM) of the first excitation light beam emitted from each of the first and second light sources 112 and 114 may be 3 nm or less. However, the disclosure is not limited thereto.

Meanwhile, the collimating lens unit 120A may be disposed between the light source unit 110A and the beam shape conversion unit 130A to collimate each of the first excitation light beams. The collimating lens unit 120A may include collimating lenses, the number of which corresponds to the number of light sources.

Referring to FIG. 2A, in the case in which the light source unit 110A includes first and second light sources 112 and 114, as described above, the collimating lens unit 120A may include first and second collimating lenses 122 and 124. One collimating lens may be assigned to each of the first and second light sources 112 and 114. In FIGS. 2A and 2B, the first and second collimating lenses 122 and 124 may be assigned respectively to the first and second light sources 112 and 114 to collimate the first excitation light beams emitted from the first and second light sources 112 and 114 and to output the collimated light beams to the beam shape conversion unit 130A. The first collimating lens 122 may be disposed between the first light source 112 and the beam shape conversion unit 130A to collimate the first excitation light beam emitted from the first light source 112, and the second collimating lens 124 may be disposed between the second light source 114 and the beam shape conversion unit 130A to collimate the first excitation light beam emitted from the second light source 114.

According to circumstances, the first and second collimating lenses 122 and 124 may be omitted. In addition, the first excitation light beam emitted from each of the first and second light sources 112 and 114 may have linearity. Alternatively, the first excitation light beam emitted from each of the first and second light sources 112 and 114 may be have linearity using the collimating lens unit 120A, even though the first excitation light beam emitted from each of the first and second light sources 112 and 114 does not have linearity.

As long as the first excitation light beams emitted from the first and second light sources 112 and 114 are output to corresponding reflective surfaces 132 and 134 of the beam shape conversion unit 130A while having linearity, as described above, there may be no particular restrictions as to the type of the first and second light sources 112 and 114, the type of the collimating lens unit 120A, and the presence or absence of the collimating lens unit 120A. Here, that the first excitation light beam has linearity may mean that the angle at which the first excitation light beam diverges or converges is 0 to 1 degrees. In addition, that the angle at which the first excitation light beam diverges or converges is 0 to 1 degrees may mean that the extent to which the first excitation light beam spreads about an optical axis of each of the first and second light sources 112 and 114 is 0 to 0.5 degrees.

The beam shape conversion unit 130A may reflect the first excitation light beams incident thereon in an incident direction parallel to an axis of symmetry SX thereof (e.g. the y-axis direction) while having linearity. The axis of symmetry SX will be described with reference to FIG. 6.

After being reflected by the beam shape conversion unit 130A, the first excitation light beams may have different beam shapes. To this end, the beam shape conversion unit 130A may include a plurality of reflective surfaces 132 and 134. The reflective surfaces 132 and 134 may have different reflection patterns for reflecting the first excitation light beams to convert the first excitation light beams into second excitation light beams.

The number of reflective surfaces of the beam shape conversion unit 130A may correspond to the number of light sources. However, the disclosure is not limited thereto.

In addition, the reflective surfaces 132 and 134 of the beam shape conversion unit 130A may be parabolic, and may be mirror-coated with metal. However, the disclosure is not limited thereto. In the case in which the reflective surfaces 132 and 134 are mirror-coated with metal, the first excitation light beams may be reflected by the reflective surfaces 132 and 134 and are converted into second excitation light beams, which may be gathered on a focal point F. The focal point F will be described in detail with reference to FIG. 6.

Referring to FIGS. 2A and 2B, the 1-1 excitation light beam L11, which has been emitted from the first light source 112 and has passed through the first collimating lens 122, may be reflected by the first reflective surface 132 of the beam shape conversion unit 130A, whereby the beam shape of the 1-1 excitation light beam L11 is changed. For the sake of convenience, a second excitation light beam, the beam shape of which is changed as the result of being reflected by the first reflective surface 132, will be referred to as a 2-1 excitation light beam L21.

In addition, the 1-2 excitation light beam L12, which has been emitted from the second light source 114 and has passed through the second collimating lens 124, may be reflected by the second reflective surface 134 of the beam shape conversion unit 130A, whereby the beam shape of the 1-2 excitation light beam L12 is changed. For the sake of convenience, a second excitation light beam, the beam shape of which is changed as the result of being reflected by the first reflective surface 134, will be referred to as a 2-2 excitation light beam L22. The first and second reflective surfaces 132 and 134 may have different reflection patterns such that the beam shape of the 2-1 excitation light beam L21 and the beam shape of the 2-2 excitation light beam L22 are different from each other.

Figure 3:
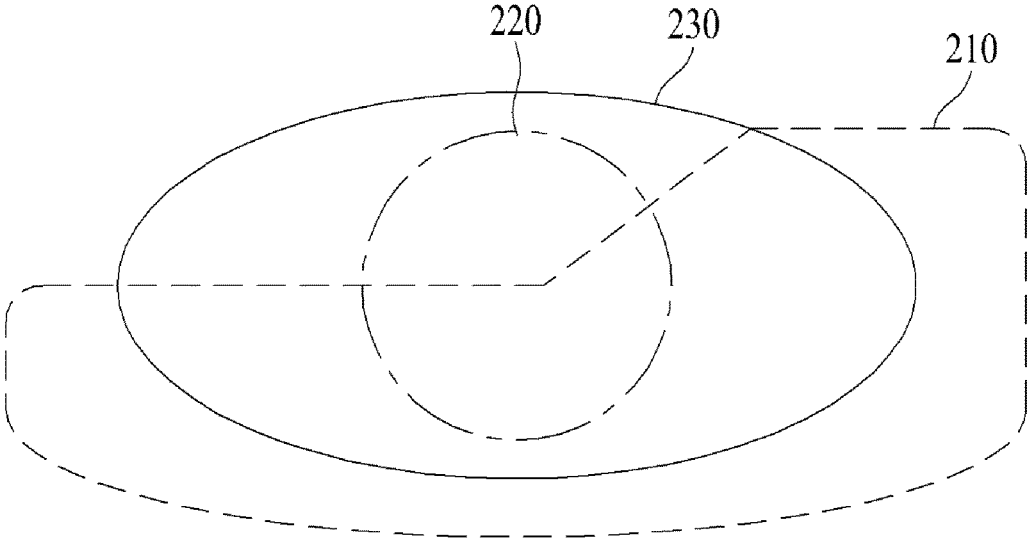
FIG. 3 is a view exemplarily showing the beam shapes of a second excitation light beam output from the light-emitting apparatus.

As shown in FIG. 3, the second excitation light beam may be radiated on an imaginary surface spaced apart from the light-emitting apparatus 100A by a predetermined distance such that the second excitation light beam has three beam shapes 210, 220, and 230. However, the disclosure is not limited thereto. In other embodiments, the second excitation light beam may have two beam shapes or four or more beam shapes. For example, in the case in which the light-emitting apparatus 100A is used in a lighting apparatus for vehicles, the beam shapes shown in FIG. 3 may be formed on a screen spaced apart from the lighting apparatus for vehicles by about 25 m.

The 1-1 excitation light beam L11 may be reflected by the first reflective surface 132, and may be converted into a 2-1 excitation light beam L21 having one of the beam shapes 210, 220, and 230 shown in FIG. 3. In addition, the 1-2 excitation light beam L12 may be reflected by the second reflective surface 134, and may be converted into a 2-2 excitation light beam L22 having another of the beam shapes 210, 220, and 230 shown in FIG. 3.

In this way, the first and second reflective surfaces 132 and 134 of the beam shape conversion unit 130A may have different reflection patterns such that the 2-1 and 2-2 excitation light beams L21 and L22 have different beam shapes. In the case in which the beam shape conversion unit 130A has a plurality of reflective surfaces, which have different reflection patterns, the second excitation light beam may have various other beam shapes in addition to the beam shapes 210, 220, and 230 shown in FIG. 3. That is, the second excitation light beam may have various light distributions.

In addition, the reflective surfaces 132 and 134 may be arranged in a direction (e.g. the z-axis direction) that intersects the direction in which the first excitation light beams L11 and L12 are incident (e.g. the y-axis direction). However, the disclosure is not limited thereto.

Figure 4A:
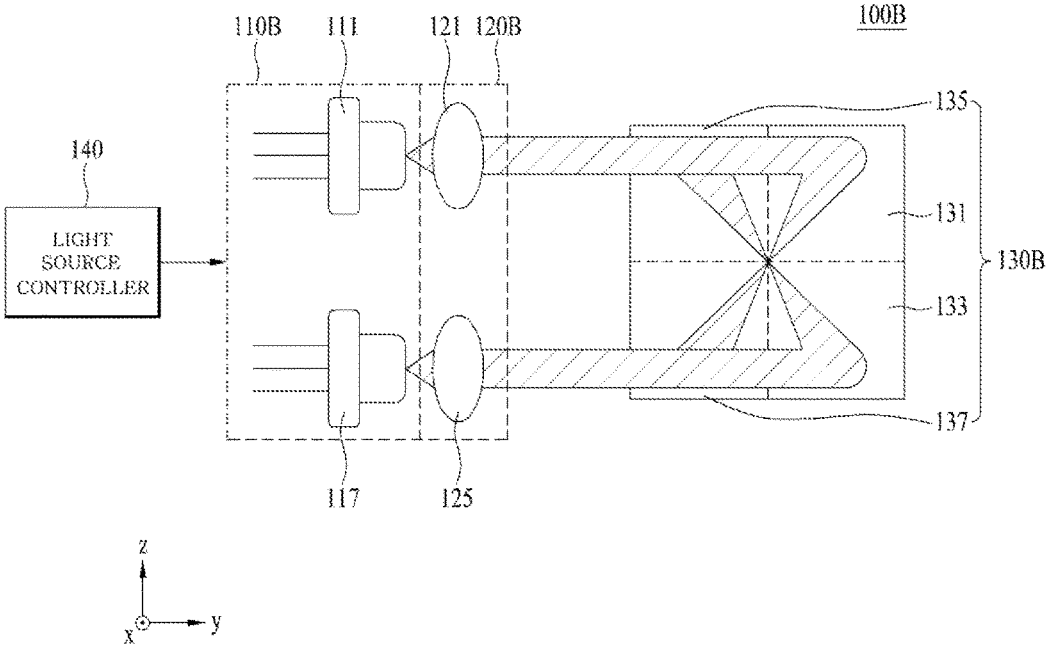
FIGS. 4A to 4C are views showing a light-emitting apparatus according to another embodiment.
Figure 4B:
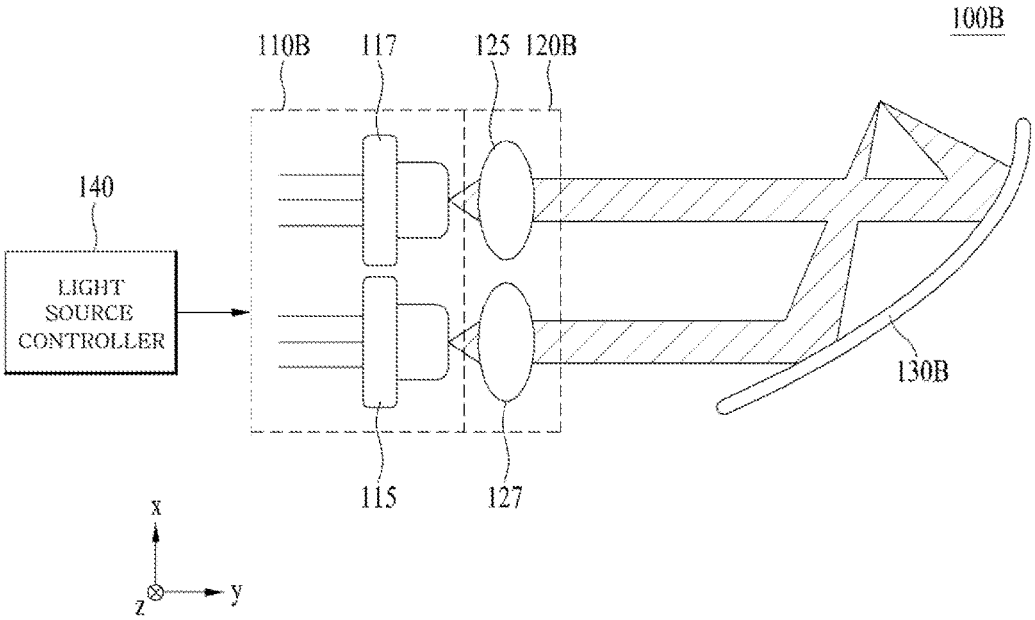
Figure 4C:
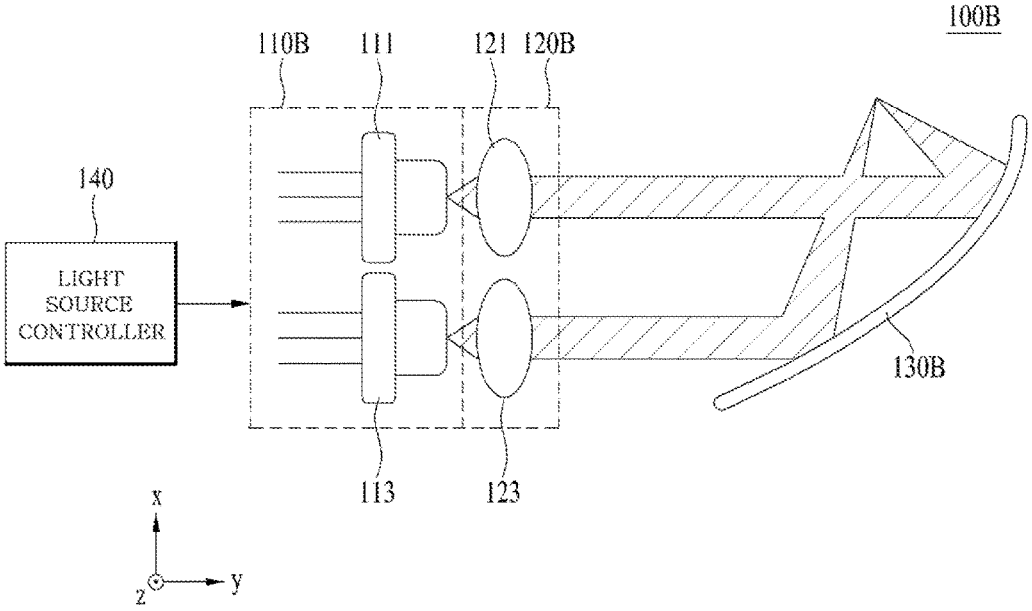

The light-emitting apparatus 100B shown in FIGS. 4A to 4C may include a light source unit 110B, a collimating lens unit 120B, and a beam shape conversion unit 130B. The light source unit 110B, the collimating lens unit 120B, and the beam shape conversion unit 130B of the light-emitting apparatus 100B shown in FIGS. 4A to 4C may perform the same functions as the light source unit 110A, the collimating lens unit 120A, and the beam shape conversion unit 130A of the light-emitting apparatus 100A shown in FIGS. 2A and 2B. However, the light source unit 110B of the light-emitting apparatus 100B shown in FIGS. 4A to 4C may include first to fourth light sources 111, 113, 115, and 117, unlike the light source unit 110A of the light-emitting apparatus 100A shown in FIG. 2A.

In addition, the collimating lens unit 120B of the light-emitting apparatus 100B shown in FIGS. 4A to 4C may include first to fourth collimating lenses 121, 123, 125, and 127, unlike the collimating lens unit 120A of the light-emitting apparatus 100A shown in FIG. 2A. Furthermore, the beam shape conversion unit 130B of the light-emitting apparatus 100B shown in FIG. 4A may include first to fourth reflective surfaces 131, 133, 135, and 137, unlike the beam shape conversion unit 130A of the light-emitting apparatus 100A shown in FIG. 2A. When comparing FIGS. 4A to 4C with FIGS. 2A and 2B, each of the first to fourth light sources 111, 113, 115, and 117 may perform the same function as each of the first and second light sources 112 and 114, each of the first to fourth collimating lenses 121, 123, 125, and 127 may perform the same function as each of the first and second collimating lenses 122 and 124, and each of the first to fourth reflective surfaces 131, 133, 135, and 137 may perform the same function as each of the first and second reflective surfaces 132 and 134.

The light-emitting apparatus 100B shown in FIGS. 4A to 4C may output a second excitation light beam having a greater variety of beam shapes than that of the light-emitting apparatus 100A shown in FIGS. 2A and 2B. The reason for this is that two reflective surfaces having different reflection patterns may be further provided. That is, the first to fourth reflective surfaces 131, 133, 135, and 137 may have different reflection patterns. However, the disclosure is not limited thereto. In other embodiments, some of the first to fourth reflective surfaces 131, 133, 135, and 137 may have the same reflection pattern.

For example, a second excitation light beam that is reflected by the first reflective surface 131 and is then output may have one of the beam shapes 210, 220, and 230 shown in FIG. 3, a second excitation light beam that is reflected by the second reflective surface 133 and is then output may have another of the beam shapes 210, 220, and 230 shown in FIG. 3, and a second excitation light beam that is reflected by the third reflective surface 135 and is then output may have the other of the beam shapes 210, 220, and 230 shown in FIG. 3. A second excitation light beam that is reflected by the fourth reflective surface 137 and is then output may have one of the beam shapes 210, 220, and 230 shown in FIG. 3.

In addition, in the case in which the light-emitting apparatus 100B is used in a lighting apparatus for vehicles, the second excitation light beams that are reflected by the first and second reflective surfaces 131 and 133 shown in FIGS. 4A to 4C and are then output may have the beam shape 210 shown in FIG. 3. The beam shape 210 may correspond to a low beam distribution of the vehicle. In addition, the second excitation light beams that are reflected by the third and fourth reflective surfaces 135 and 137 and are then output may have the beam shape 220 shown in FIG. 3. The beam shape 220 may correspond to a high beam distribution of the vehicle. For reference, the beam shape of the upper beam of the vehicle may correspond to the light distribution of the vehicle obtained by combining the two beam shapes 210 and 220.

In addition, the light-emitting apparatus 100B shown in FIGS. 4A to 4C may further include a light source controller 140. The light source controller 140 may selectively turn the light sources 111, 113, 115, and 117 on or off in order to emit only some of the first excitation light beams. When turned on by the light source controller 140, the light sources 111, 113, 115, and 117 emit the first excitation light beams. When turned off by the light source controller 140, the light sources 111, 113, 115, and 117 do not emit the first excitation light beams.

In the case in which the light-emitting apparatus 100B is used in a lighting apparatus for vehicles, the first and fourth light sources 111 and 117 may be turned on, and the second and third light sources 113 and 115 may be turned off, in order to constitute a low beam of the vehicle. In this case, second excitation light beams that have the beam shape 210 shown in FIG. 3 may be output from the first and second reflective surfaces 131 and 133. In order to constitute a high beam of the vehicle, all of the light sources 111, 113, 115, and 117 may be turned on. In this case, second excitation light beams that have the beam shape 210 shown in FIG. 3 may be output from the first and second reflective surfaces 131 and 133, and second excitation light beams that have the beam shape 220 shown in FIG. 3 may be output from the third and fourth reflective surfaces 135 and 137.

Figure 5:
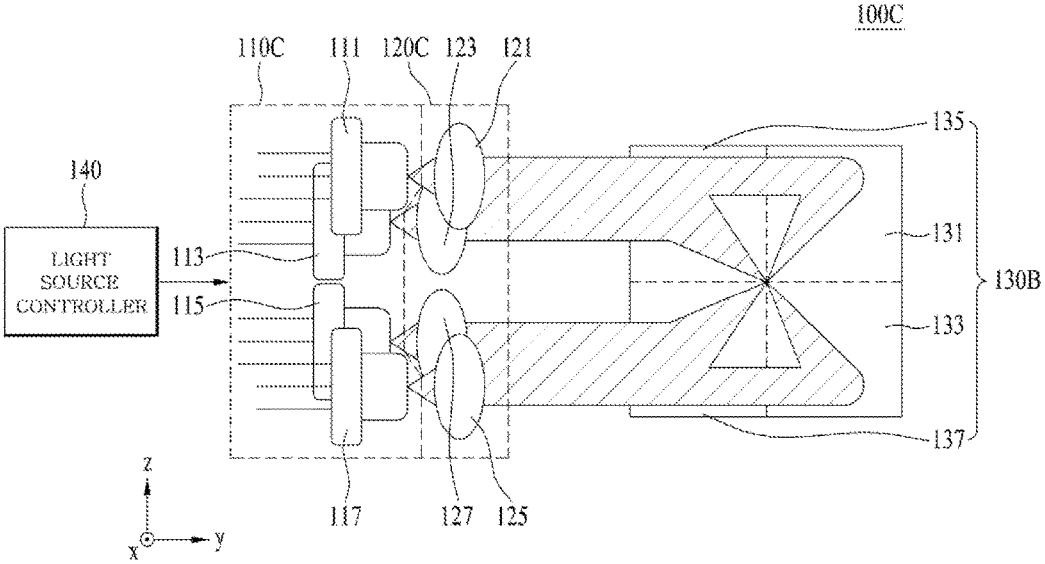
FIG. 5 is a plan view showing a light-emitting apparatus according to another embodiment.

The light-emitting apparatus 100C shown in FIG. 5 may include a light source unit 110C, a collimating lens unit 120C, and a beam shape conversion unit 130C. In the light-emitting apparatus 100B shown in FIGS. 4A to 4C, the first and second light sources 111 and 113 of the light source unit 110B are arranged side by side in the direction (e.g. the x-axis direction) that is perpendicular to the direction in which the first excitation light beams are emitted (e.g. the y-axis direction), and the third and fourth light sources 115 and 117 of the light source unit 110B are arranged side by side in the x-axis direction. In the light-emitting apparatus 100C shown in FIG. 5, on the other hand, the first and second light sources 111 and 113 of the light source unit 110C are not arranged side by side in the x-axis direction, and the third and fourth light sources 115 and 117 of the light source unit 110C are not arranged side by side in the x-axis direction.

In addition, the first and second collimating lenses 121 and 123 of the collimating lens unit 120B of the light-emitting apparatus 100B are arranged side by side in a direction (e.g. the x-axis direction) that is perpendicular to the direction in which the first excitation light beams are emitted (e.g. the y-axis direction), and the third and fourth collimating lenses 125 and 127 of the collimating lens unit 120B are arranged side by side in the x-axis direction. In the light-emitting apparatus 100C shown in FIG. 5, on the other hand, the first and second collimating lenses 121 and 123 of the collimating lens unit 120C are not arranged side by side in the x-axis direction, and the third and fourth collimating lenses 125 and 127 of the collimating lens unit 120C are not arranged side by side in the x-axis direction.

Except for the above differences, the light-emitting apparatus 100C shown in FIG. 5 is identical to the light-emitting apparatus 100B shown in FIGS. 4A to 4C. Consequently, the same reference numerals are used, and a duplicate description will be omitted.

Figure 6:
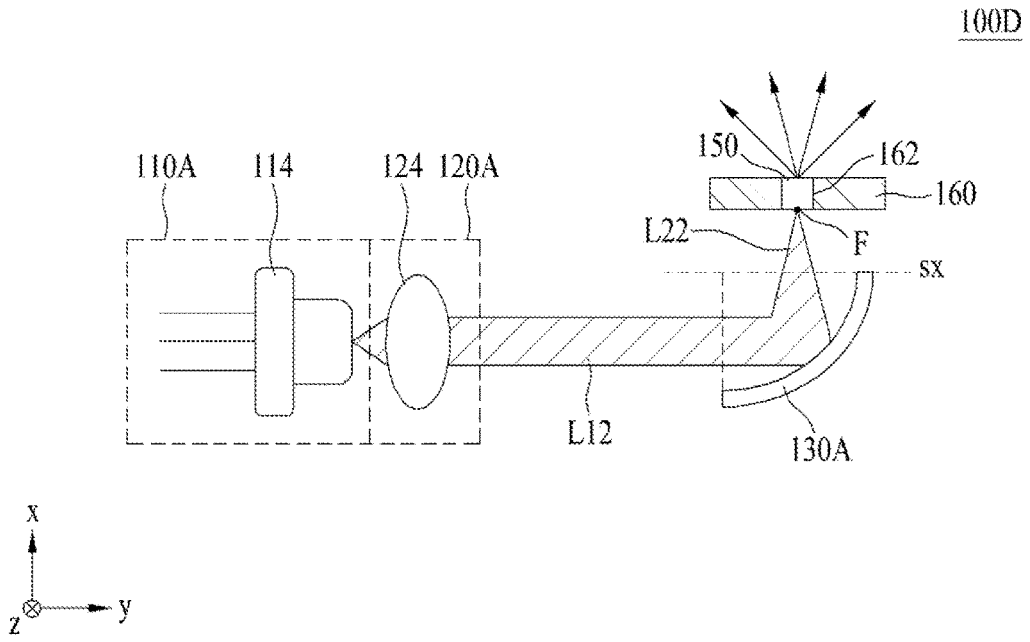
FIG. 6 is a front view showing a light-emitting apparatus according to another embodiment.

The light-emitting apparatus 100D shown in FIG. 6 may include a light source unit 110A, a collimating lens unit 120A, a beam shape conversion unit 130A, a wavelength conversion unit 150, and a base substrate 160. The light source unit 110A, the collimating lens unit 120A, and the beam shape conversion unit 130A shown in FIG. 6 may be identical to the light source unit 110A, the collimating lens unit 120A, and the beam shape conversion unit 130A shown in FIGS. 2A and 2B. Consequently, the same reference numerals are used, and a duplicate description will be omitted. In other embodiments, however, the light source unit 110A, the collimating lens unit 120A, and the beam shape conversion unit 130A shown in FIG. 6 may be replaced with the light source unit 110B, the collimating lens unit 120B, and the beam shape conversion unit 130B shown in FIGS. 4A to 4C, or may be replaced with the light source unit 110C, the collimating lens unit 120C, and the beam shape conversion unit 130C shown in FIG. 5.

In addition, the light-emitting apparatus 100D may further include the base substrate 160. The base substrate 160 may include a through hole 162, through which the wavelength conversion unit 150 may be inserted. The base substrate 160 may thus receive the wavelength conversion unit 150 therein.

Furthermore, the base substrate 160 may dissipate heat generated from the wavelength conversion unit 150. To this end, the base substrate 160 may be a transparent alumina (i.e. aluminum oxide) substrate. However, the disclosure is not limited thereto.

In FIG. 6, the beam shape conversion unit 130A is shown as being spaced apart from the base substrate 160. However, the disclosure is not limited thereto. In other embodiments, the beam shape conversion unit 130A may be fixed to the base substrate 160 (i.e. the beam shape conversion unit 130A may be in contact with the base substrate 160).

In the case in which the light-emitting apparatus 100D includes the wavelength conversion unit 150, as shown in FIG. 6, the beam shape conversion unit 130A may reflect a plurality of first excitation light beams incident thereon in an incident direction (e.g. the y-axis direction) while having linearity to convert the first excitation light beams into second excitation light beams and gather the second excitation light beams on a focal point F. The incident direction may be a direction parallel to an axis of symmetry SX of the beam shape conversion unit 130A. A line extending from the top surface of the beam shape conversion unit 130A in the horizontal direction (e.g. the y-axis direction) may be parallel to the axis of symmetry. In addition, in the case in which the beam shape conversion unit 130A is parabolic, the focal point F may be a parabolic focal point.

When a plurality of first excitation light beams having linearity, emitted from the light sources 112 and 114, is incident in the direction parallel to the axis of symmetry SX, the beam shape conversion unit 130A may reflect the first excitation light beams so as to convert the first excitation light beams into second excitation light beams, and may gather the second excitation light beams on a point of the focal point F. The wavelength conversion unit 150 may be disposed on the focal point F of the beam shape conversion unit 130A. The wavelength conversion unit 150 may transmit the second excitation light beams, reflected by the beam shape conversion unit 130A and gathered on the focal point F, to convert the wavelengths of the second excitation light beams, and outputs the light beams having converted wavelengths (hereinafter, referred to as "converted light beams"). While passing through the wavelength conversion unit 150, the wavelengths of the second excitation light beams may be converted. However, not all of the light beams transmitted through the wavelength conversion unit 150 may be light beams having converted wavelengths.

The wavelength conversion unit 150 may be a set of numberless point light sources, and each point light source may absorb a second excitation light beam and emit a converted light beam. In general, for a reflective-type wavelength conversion unit, the optical path of a second excitation light beam and the optical path of a converted light beam may overlap each other. For this reason, it may be difficult to configure a second excitation light beam optical system such that the second excitation light beam optical system does not interfere with the optical path of the converted light beam. In addition, in the case in which a portion of the lighting optical system is not used, lighting efficiency may be reduced. In the case in which the second excitation light beam is obliquely incident, the spot size of the focus may be increased, thereby defeating the purpose of using the laser diode as the light source.

Since the wavelength conversion unit 150 shown in FIG. 6 is of a transmissive type, the optical path of a second excitation light beam and the optical path of a converted light beam may not overlap each other. Consequently, the structure of the optical system may be simpler than that of the reflective-type optical system. Furthermore, it may be possible to gather a plurality of second excitation light beams on the focal point F of the wavelength conversion unit 150 using the beam shape conversion unit 130A in place of the complicated optical system.

In addition, the reflective-type wavelength conversion unit may have problems in that it is difficult to block blue laser light that is not incident on the wavelength conversion unit but is mirror-reflected by the surface of the wavelength conversion unit and in that the laser light may be exposed to the outside when the apparatus is damaged, whereby the safety of the reflective-type wavelength conversion unit is low. In the transmissive-type wavelength conversion unit 150, on the other hand, there is no possibility of the blue laser light being exposed to the outside as long as no hole is formed in the wavelength conversion unit 150, whereby the safety of the wavelength conversion unit is high. In addition, blue excitation light beams may not be mixed with each other. Consequently, the transmissive-type wavelength conversion unit may be more advantageous than the reflective-type wavelength conversion unit in terms of color distribution.

The wavelengths of the second excitation light beams may be converted by the wavelength conversion unit 150, with the result that white light or light having a desired color temperature may be output from the light-emitting apparatus 100D. To this end, the wavelength conversion unit 150 may include at least one selected from among phosphor, such as ceramic phosphor, lumiphore, and YAG single-crystal. Here, lumiphore may be a luminescent material or a structure including such a luminescent material.

In addition, the concentration, particle size, and particle distribution of various materials included in the wavelength conversion unit 150, the thickness and surface roughness of the wavelength conversion unit 150, and air bubbles in the wavelength conversion unit 150 may be adjusted to output light that has a desired color temperature from the light-emitting apparatus 100D. For example, the wavelength conversion unit 150 may convert a wavelength band of light ranging from 3000 K to 9000 K. The color temperature range of a converted light beam that has a wavelength converted by the wavelength conversion unit 150 may be 3000 K to 9000 K. However, the disclosure is not limited thereto.

In addition, the wavelength conversion unit 150 may have various shapes. For example, the wavelength conversion unit 150 may be a phosphor-in-glass (PIG) type wavelength conversion unit, a poly crystal-line (or ceramic) type wavelength conversion unit, or a monocrystalline type wavelength conversion unit. However, the disclosure is not limited thereto.

Figure 7:
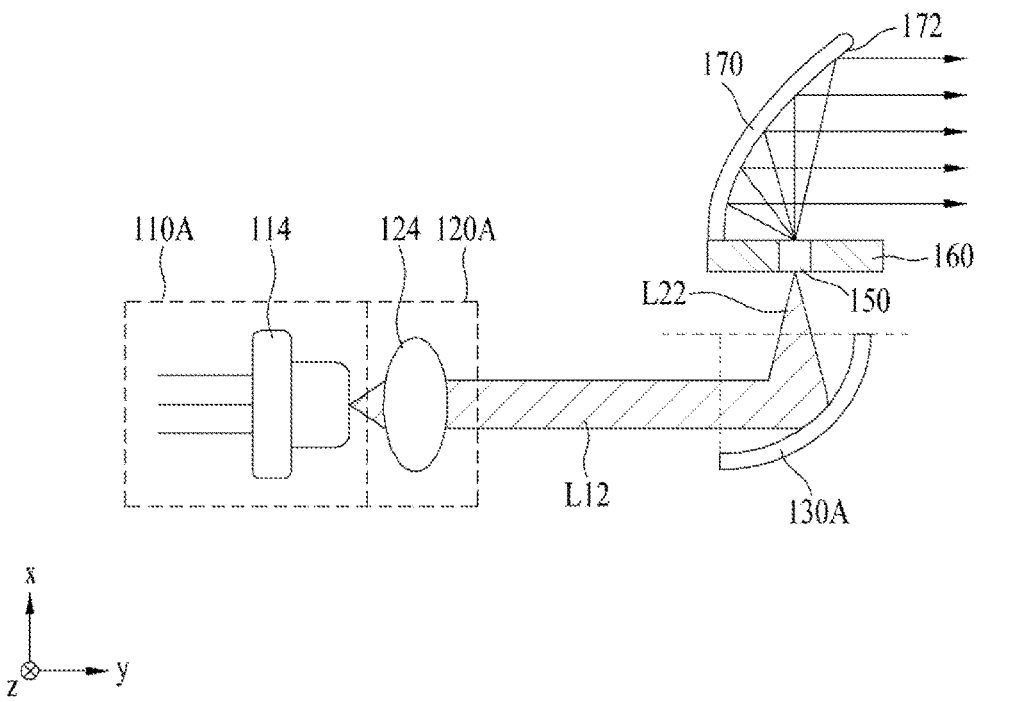
FIG. 7 is a front view showing a light-emitting apparatus according to another embodiment.

The light-emitting apparatus 100E shown in FIG. 7 may include a light source unit 110A, a collimating lens unit 120A, a beam shape conversion unit 130A, a wavelength conversion unit 150, a base substrate 160, and a reflection unit 170. With the exception of the additional inclusion of the reflection unit 170, the light-emitting apparatus 100E shown in FIG. 7 is identical to the light-emitting apparatus 100D shown in FIG. 6. Consequently, the same reference numerals are used, and a duplicate description will be omitted.

The reflection unit 170 may reflect a converted light beam that is output from the wavelength conversion unit 150. The reflection unit 170 may be fixed to the base substrate 160. The reflection unit 170 may reflect a converted light beam that is output from the wavelength conversion unit 150, and may output the reflected light. The reflection unit 170 may have a parabolic surface 172. The parabolic surface 172 may be mirror-coated with metal in order to reflect the converted light beam. In other embodiments, the parabolic surface 172 may be appropriately inclined such that the entire converted light beam is reflected. In this case, the parabolic surface 172 may not be mirror-coated with metal.

In addition, a plurality of reflective surfaces of the beam shape conversion unit 130A and the reflection unit 170 may each include at least one selected from an aspherical surface, a freeform curve surface, a Fresnel lens, and a holography optical element (HOE) depending on desired luminance distribution. The freeform curved surface may be a shape having various curved surfaces.

In addition, in the case in which the beam shape conversion unit 130A shown in FIG. 7 is disposed in contact with the base substrate 160, a refraction member (not shown) may occupy the entire space through which a plurality of second excitation light beams passes such that no air is present in the space through which the second excitation light beams pass. As a result, the second excitation light beams reflected by the beam shape conversion unit 130A may reach the focal point F of the wavelength conversion unit 150 via the refraction member without being exposed to the air.

In addition, a refraction member may occupy the entire space through which converted light beams pass such that no air is present in the space through which the converted light beams pass. As a result, the converted light beams may reach the reflection unit 170 via the refraction member without being exposed to the air.

Figure 8:
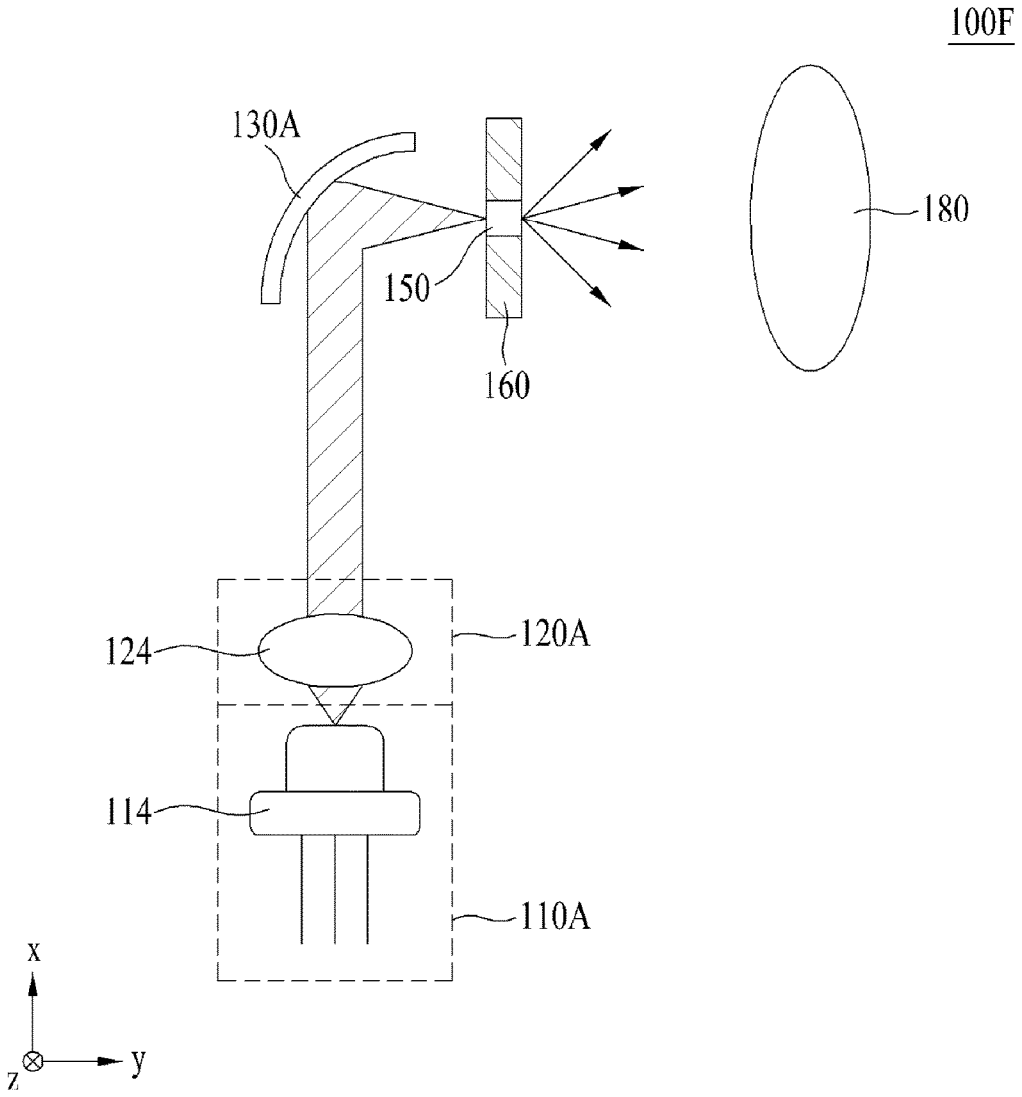
FIG. 8 is a front view showing a light-emitting apparatus according to another embodiment.

The light-emitting apparatus 100F shown in FIG. 8 may include a light source unit 110A, a collimating lens unit 120A, a beam shape conversion unit 130A, a wavelength conversion unit 150, a base substrate 160, and a projection lens unit 180. With the exception of the additional inclusion of the projection lens unit 180, the light-emitting apparatus 100F shown in FIG. 8 is identical to the light-emitting apparatus 100D shown in FIG. 6. Consequently, the same reference numerals are used, and a duplicate description will be omitted.

The projection lens unit 180 transmits a converted light beam that is output from the wavelength conversion unit 150. In the case in which the light-emitting apparatus 100F is used in a lighting apparatus for vehicles, the projection lens unit 180 may correspond to the lens of a headlamp that is mounted in the lighting apparatus for vehicles.

Figure 9:
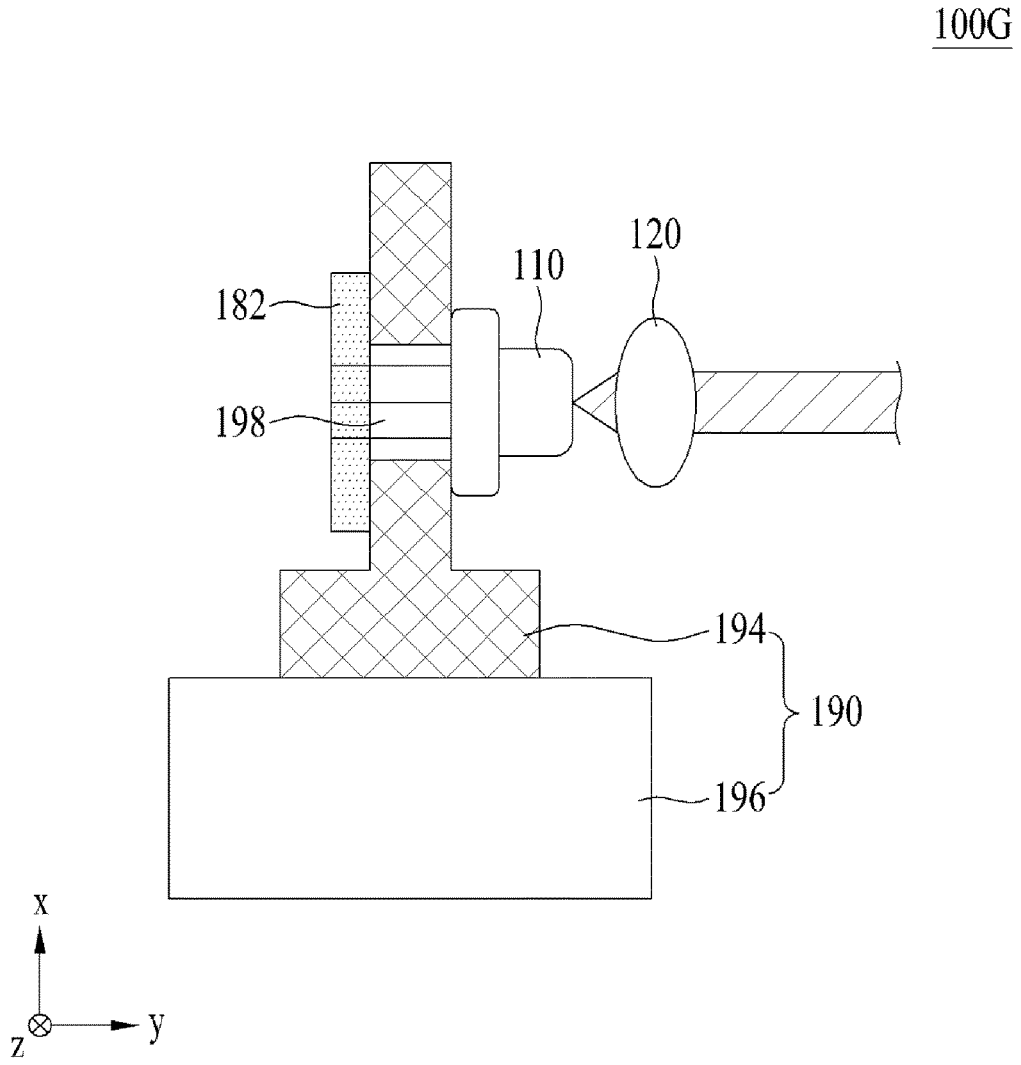
FIG. 9 is a partial front view showing a light-emitting apparatus according to a further embodiment.

The light-emitting apparatus 100G shown in FIG. 9 may include a light source unit 110, a collimating lens unit 120, a driving unit 182, and a heat dissipation unit 190. The driving unit 182 may drive the light source unit 110. The driving unit 182 may include the light source controller 140 shown in FIGS. 4A to 4C or FIG. 5.

The light source unit 110 may correspond to the above-described light source unit 110A, 110B, or 1100, and the collimating lens unit 120 may correspond to the above-described collimating lens unit 120A, 120B, or 120C. Consequently, a duplicate description will be omitted. In addition, the light-emitting apparatus 100G may further include the above-described beam shape conversion unit 130A or 130B, and may selectively further include at least one selected from the wavelength conversion unit 150, the base substrate 160, the reflection unit 170, and the projection lens unit 180.

The heat dissipation unit 190 may be connected to the light source unit 110 to dissipate heat generated from the light source unit 110. For example, the heat dissipation unit 190 may include a connection part 194 and a heat dissipation plate 196. The connection part 194 may be connected to the light source unit 110 to absorb and dissipate heat generated from the light source unit 110 or to transfer the heat to the heat dissipation plate 196. To this end, the connection part 194 may be made of a material that exhibits high thermal conductivity, such as aluminum.

In addition, the connection part 194 may include a light source insertion part 198. The light source unit 110 may be inserted into the light source insertion part 198 so as to be connected to the connection part 194. The light source insertion part 198 may be filled with air or a material that exhibits electrical non-conductivity and high thermal conductivity.

The heat dissipation plate 196 may be connected to the connection part 194 to discharge heat that is received from the light source unit 110 through the connection part 194 to the outside. For example, the heat dissipation plate 196 may be made of a metal material or alumina ($Al_2O_3$). However, the disclosure is not limited thereto. That is, any material that is capable of dissipating heat may be used as the heat dissipation plate 196. The light-emitting apparatuses 100A to 100G according to the above-described embodiments may variously convert the beam shapes of the first excitation light beams using the beam shape conversion unit 130A or 130B, and may output the second excitation light beams.

In addition, the light-emitting apparatuses 100A to 100G according to the above-described embodiments may be used in various fields. For example, the light-emitting apparatuses 100A to 100G may be used in a lighting apparatus for vehicles. In this case, the light-emitting apparatuses 100A to 100G may be used in various lamps for vehicles (e.g. a low beam, a high beam, a tail light, a side light, a signal light, a day running light (ORL), and a fog light), a flashlight, a signal light, or various lighting devices.

For example, in the case in which the light-emitting apparatuses 100A to 100G are used in a lighting apparatus for vehicles, particularly a headlamp, a plurality of light sources may be selectively turned on or off using the light source controller 140. Consequently, the light-emitting apparatuses 100A to 100G may be used to constitute the high beam as well as the low beam even though only a single optical system is used. As a result, it may be possible to reduce manufacturing cost, to simplify the mechanical structure of the headlamp, and to slim the headlamp.

Furthermore, the reflective surfaces of the beam shape conversion unit 130A or 130B may have various reflection patterns in order to output beams having various shapes as well as the high beam and the low beam. The beams having various shapes may include beams suitable for the environments around the lighting apparatus for vehicles. Consequently, the light-emitting apparatuses 100A to 100G may be used in various lighting apparatuses for vehicle in addition to the high beam and the low beam.

In addition, in the light-emitting apparatuses 100A to 100G, the laser diode may be used as the light source. The laser diode may have a small size even though the laser diode provides the same intensity of light as a conventional light source, such as a light-emitting diode. Consequently, it may be possible to further slim the light-emitting apparatuses.

As is apparent from the above description, in a light-emitting apparatus according to an embodiment and a lighting apparatus for vehicles including the same, it may be possible to generate light having various beam shapes using a single optical system. In particular, a high beam and a low beam may be realized as a single optical system. Consequently, it may be possible to simplify the mechanical structure of the lighting apparatus for vehicles, to reduce the cost of manufacturing the lighting apparatus for vehicles, and to slim the lighting apparatus for vehicles.

Embodiments provide a light-emitting apparatus that is capable of generating light having various beam shapes and a lighting apparatus for vehicles including the same. A light-emitting apparatus may include a light source unit for emitting a first excitation light beam, a beam shape conversion unit for reflecting the first excitation light beam and outputting the reflected first excitation light beam as a second excitation light beam, and a driving unit for driving the light source unit, wherein the beam shape conversion unit includes a plurality of reflective surfaces having different reflection patterns, and the reflective surfaces are arranged in a direction that intersects the direction in which the first excitation light beam is incident.

The light-emitting apparatus may further include a collimating lens disposed between the light source unit and the beam shape conversion unit. The light-emitting apparatus may further include a wavelength conversion unit, having a focal point, for transmitting the second excitation light beam gathered on the focal point and emitting the transmitted second excitation light beam as a converted light beam.

The light source unit may include a plurality of light sources, whereby the light source unit emits a plurality of first excitation light beams. The driving unit may include a controller for performing control such that the light source unit is turned on or off.

The controller may perform control such that the first excitation light beams are selectively emitted from the light source unit. The light-emitting apparatus may further include a light source insertion part, into which the light source unit is inserted, and a connection part abutting the light source unit and the light source insertion part for interconnecting the light source insertion part and the light source unit.

The light-emitting apparatus may further include a heat dissipation plate abutting the connection part. The light-emitting apparatus may further include a base substrate comprising a through hole, through which the wavelength conversion unit is mounted, and a reflective material layer disposed on the surface of the base substrate.

The light-emitting apparatus may further include a reflection unit disposed on the base substrate for reflecting the converted light beam. The light-emitting apparatus may further include a refraction member disposed between the reflection unit and the base substrate. The beam shape conversion unit may be spaced apart from the base substrate.

A lighting module for vehicles may include a light-emitting apparatus. The light-emitting apparatus may include a light source unit for emitting a first excitation light beam, a beam shape conversion unit for reflecting the first excitation light beam and outputting the reflected first excitation light beam as a second excitation light beam, a wavelength conversion unit, having a focal point, for transmitting the second excitation light beam gathered on the focal point and emitting the transmitted second excitation light beam as a converted light beam, and a driving unit for driving the light source unit. The beam shape conversion unit may include a plurality of reflective surfaces having different reflection patterns, and the reflective surfaces may be arranged in a direction that intersects the direction in which the first excitation light beam is incident.

The light source unit may include a plurality of light sources, and at least two of the light sources may be arranged side by side in an axial direction perpendicular to the direction in which the first excitation light beam is incident. The driving unit may include a controller for performing control such that the light sources are selectively turned on or off.

The light-emitting apparatus may further include a light source insertion part, into which the light source unit is inserted, a connection part abutting the light source unit and the light source insertion part for interconnecting the light source insertion part and the light source unit, and a heat dissipation plate abutting the connection part. The light-emitting apparatus may further include a base substrate including a through hole, through which the wavelength conversion unit is mounted, and a reflective material layer disposed on a surface of the base substrate.

The light-emitting apparatus may further include a reflection unit disposed on the base substrate for reflecting the converted light beam emitted from the wavelength conversion unit and a refraction member disposed between the reflection unit and the base substrate. The beam shape of the second excitation light beam may have a distribution corresponding to a low beam. The beam shape of the second excitation light beam may have a distribution corresponding to a high beam.

Reference will now be made in detail to preferred embodiments, examples of which are illustrated in the accompanying drawings. However, the embodiments may be modified into various other forms. The embodiments are not restrictive but are illustrative. The embodiments are provided to more completely explain the disclosure to a person having ordinary skill in the art.

It will be understood that when an element is referred to as being "on" or "under" another element, it can be directly on/under the element, or one or more intervening elements may also be present.

When an element is referred to as being "on" or "under," "under the element" as well as "on the element" may be included based on the element.

In addition, relational terms, such as "first," "second," "on/upper part/above" and "under/lower part/below," are used only to distinguish between one subject or element and another subject and element without necessarily requiring or involving any physical or logical relationship or sequence between such subjects or elements.

Hereinafter, light-emitting apparatuses 100A to 100G according to embodiments will be described with reference to the accompanying drawings. For the sake of convenience, the light-emitting apparatuses 100A to 100G will be described using a Cartesian coordinate system (x, y, z). However, the disclosure is not limited thereto. That is, other different coordinate systems may be used. In the drawings, an x-axis, a y-axis, and a z-axis of the Cartesian coordinate system are perpendicular to each other. However, the disclosure is not limited thereto. That is, the x-axis, the y-axis, and the z-axis may intersect each other.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with the other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A light-emitting apparatus comprising:

a plurality of light sources to emit a plurality of first excitation light beams;

a driving unit to drive the plurality of light sources;

a beam shape conversion unit to reflect the plurality of first excitation light beams and provide a plurality of second excitation light beams, wherein the beam shape conversion unit includes a plurality of reflective surfaces having different patterns, wherein a first one of the reflective surfaces has a first pattern, and a first one of the first excitation light beams to reflect from the first pattern and to provide a first one of the second excitation light beams having a first shape, and a second one of the reflective surfaces has a second pattern different than the first pattern, and a second one of the first excitation beams to reflect from the second pattern and to provide a second one of the second excitation light beams having a second shape different than the first shape, and each of the reflective surfaces are arranged in a direction that intersects a direction in which the corresponding one of the first excitation light beams is incident, wherein the first one of the reflective surfaces is arranged in an incident direction of the first one of the first excitation light beams, and the second one of the reflective surfaces is arranged in an incident direction of the second one of the first excitation light beams, wherein:

the plurality of light sources comprises at least a first light source, a second light source, a third light source and a fourth light source, the first light source and the fourth light source are aligned in a lateral direction perpendicular to an optical axis, the second light source and the third light source are aligned in the lateral direction, the first light source and the second light source are not aligned in a vertical direction perpendicular to the optical axis and perpendicular to the lateral direction, and the third light source and the fourth light source are not aligned in the vertical direction.

2. The light-emitting apparatus according to claim 1, further including a collimating lens provided between the at least one light source and the beam shape conversion unit.

3. The light-emitting apparatus according to claim 1, comprising a wavelength conversion unit, having a focal point, to transmit the plurality of second excitation light beams gathered on the focal point and emit the transmitted second excitation light beams as a converted light beam.

4. The light-emitting apparatus according to claim 3, further including:

a base substrate having a through hole, through which the wavelength conversion unit is mounted; and a reflective material layer provided on a surface of the base substrate.

5. The light-emitting apparatus according to claim 4, further including a reflection unit provided on the base substrate to reflect the converted light beam.

6. The light-emitting apparatus according to claim 5, further including a refraction member provided between the reflection unit and the base substrate.

7. The light-emitting apparatus according to claim 6, wherein the beam shape conversion unit is spaced apart from the base substrate.

8. The light-emitting apparatus according to claim 1, wherein the driving unit includes a controller to control turning each of the plurality of light sources on or off.

9. The light-emitting apparatus according to claim 8, wherein the controller performs control such that the plurality of first excitation light beams are selectively emitted from the plurality of light sources.

10. The light-emitting apparatus according to claim 1, comprising:

a light source insertion part, into which the plurality of light sources are inserted; and a connection part abutting the plurality of light sources and the light source insertion part to interconnect the light source insertion part and the plurality of light sources.

11. The light-emitting apparatus according to claim 10, comprising a heat dissipation plate abutting the connection part.

12. A lighting module for vehicles comprising a light-emitting apparatus, the light-emitting apparatus comprising:

a light source unit to emit a plurality of first excitation light beams;

a beam shape conversion unit to reflect the plurality of first excitation light beams and provide a plurality of second excitation light beams;

a wavelength conversion unit, having a focal point, to transmit the plurality of second excitation light beams gathered on the focal point and emit the transmitted second excitation light beams as a converted light beam; and a driver to drive the light source unit, wherein the beam shape conversion unit includes a plurality of reflective surfaces having different patterns, wherein a first one of the reflective surfaces has a first pattern, and a first one of the first excitation light beams to reflect from the first pattern and to provide a first one of the second excitation light beams having a first shape, and a second one of the reflective surfaces has a second pattern different than the first pattern, and a second one of the first excitation beams to reflect from the second pattern and to provide a second one of the second excitation light beams having a second shape different than the first shape, and each of the reflective surfaces are arranged in a direction that intersects a direction in which the corresponding one of the first excitation light beams is incident, wherein the first one of the reflective surfaces is arranged in an incident direction of the first one of the first excitation light beams, and the second one of the reflective surfaces is arranged in an incident direction of the second one of the first excitation light beams, wherein:

the light source unit includes at least a first light source, a second light source, a third light source and a fourth light source, the first light source and the fourth light source are aligned in a lateral direction perpendicular to an optical axis, the second light source and the third light source are aligned in the lateral direction, the first light source and the second light source are not aligned in a vertical direction perpendicular to the optical axis and perpendicular to the lateral direction, and the third light source and the fourth light source are not aligned in the vertical direction.

13. The lighting module according to claim 12, wherein the driver includes a controller to control turning the light sources on or off.

14. The lighting module according to claim 12, wherein the light-emitting apparatus further comprises:

a light source insertion part, into which the light source unit is inserted;

a connection part abutting the light source unit and the light source insertion part to interconnect the light source insertion part and the light source unit; and a heat dissipation plate abutting the connection part.

15. The lighting module according to claim 12, wherein the light-emitting apparatus further includes:

a base substrate having a through hole, through which the wavelength conversion unit is mounted; and a reflective material layer provided on a surface of the base substrate.

16. The lighting module according to claim 15, wherein the light-emitting apparatus further includes:

a reflection unit provided on the base substrate to reflect the converted light beam emitted from the wavelength conversion unit; and a refraction member provided between the reflection unit and the base substrate.

17. The lighting module according to claim 12, wherein a beam shape of the second excitation light beam has a distribution corresponding to a low beam.

18. The lighting module according to claim 12, wherein a beam shape of the second excitation light beam has a distribution corresponding to a high beam.

* * * * *